United States Patent [19]

Czauderna et al.

[11] 4,008,921

[45] Feb. 22, 1977

[54] AUTOMATIC EXCAVATING MACHINE AND METHOD OF OPERATING THE SAME

[75] Inventors: Norbert Czauderna; Günther Fenske, both of Kirchhellen; Karl-Heinz Klimek; Siegfried Lubina, both of Bottrop; Fritz Malinowski, Kirchhellen; Bernhard Schönrock, Dinslaken, all of Germany

[73] Assignee: Ruhrkohle AG, Essen, Germany

[22] Filed: June 19, 1975

[21] Appl. No.: 588,518

[30] Foreign Application Priority Data

June 21, 1974 Germany ..... 2429774

[52] U.S. Cl. ..... 299/1

[51] Int. Cl.[2] ..... E21C 41/00

[58] Field of Search ..... 299/1

[56] References Cited

UNITED STATES PATENTS 3,531,159 9/1970 Schmidt ..... 299/1

FOREIGN PATENTS OR APPLICATIONS 154,209 9/1963 U.S.S.R. ..... 299/1

OTHER PUBLICATIONS

B425,345, Jan. 1975, Poundstone, 299, 1.

*Primary Examiner*—Ernest R. Purser
*Attorney, Agent, or Firm*—Michael J. Striker

[57] ABSTRACT

Mineralogical measurements are performed at a plurality of locations along the face of an excavation to determine the shape of a mineral interface along such face. An interface-shape program is set up in a programmable control arrangement operative for causing an excavating machine to excavate in accordance with the program during at least one working trip. Only after the program has been set up in the control arrangement is the excavating machine caused to perform at least one working trip under the automatic control of the control arrangement. When the excavation is such that the actual interface shape is not well-defined, continuous and smooth, the interface-shape program set up in the programmable control arrangement is made to correspond to an interface which is well-defined, continuous and smooth by comparison with the actual interface, to make possible automatic working of an excavation not capable of being worked by automatic excavating machines of the type which automatically detect the physical interface during a working trip and excavate in dependence upon such automatica detection.

7 Claims, 11 Drawing Figures

AUTOMATIC EXCAVATING MACHINE AND METHOD OF OPERATING THE SAME

BACKGROUND OF THE INVENTION

The present invention relates to a method and apparatus for the control of an excavating machine, particularly a cutter loader, in an underground excavation.

More particularly, the invention relates to that type of automatic control of the operation of a cutter loader wherein the face conveyor upon which the cutter loader is mounted serves to define an artificial horizontal serving as a reference for various aspects of the automatic control.

Particularly when the seam being cut is of relatively small thickness, for example 1 to 1.5 meters, control of the cutter loader under the direct supervision of a human operator is disadvantageous. If the human operator actually accompanies the cutter loader as the latter travels along the face, the human operator will not be able to stand upright and as a result may have considerable difficulty in observing the conditions which he must take into consideration in adjusting the height of the cutter; of course, the human operator may have great difficulty in obtaining access to so low a space at all. On the other hand, if the human operator controls the operation of the cutter loader from a more convenient distance, by radio remote control, it is evident that he will likewise not be in the best possible position to observe the face conditions which ideally should determine his control of the cutter height. Furthermore, in either event, reliance must be made upon the personal skill of the human operator of the cutter loader, and such skill is very difficult to develop.

Accordingly, attempts have already been made in the mining industry to provide for the automatic control of cutter loaders, in order to maximize the speed with which the cutter loader can excavate along the length of the face, and in order to maximize the amount of coal and minimize the amount of adjoining rock cut, and in order to create a reduced demand upon the skill of the human operator.

Particularly in the Eastern-bloc European countries and also in Great Britain (see for example "Bretby Broadsheet," July/September, 1968, No. 44, pp. 3–4), methods for the automatic control of the operation of cutter loaders have come into existence. With these methods, there is first of all established an artificial horizontal to serve as a plane of reference for the position and inclination of automatically operating cutting instrumentalities. Usually, the cutter loader is mounted for movement along the length of a face conveyor laid alongside the face being worked, and the face conveyor is utilized as the artificial horizontal.

With these known automatic-control methods, it is desired that the cutting roller be made to automatically follow the interface between coal and adjoining rock. In this way, supposedly, the cut will exactly correspond to the interface; or, in situations where the roof must be made of coal, the cut will be parallel to and spaced a predetermined distance from the interface. To detect the location of the coal-rock interface as the cutter loader proceeds along the face being worked, use is made of isotope test probes or measuring drill devices which can detect the difference in mineralogical or mechanical characteristics of the two different materials at the coal-rock interface. The heights of the cutter rollers of the cutter loader are automatically adjusted in dependence upon such detection, as the cutter loader proceeds along the face. It is also known to employ an inclinometer for detecting transverse tilting or climbing of the cutter loader. This transverse climbing is most often due to the accumulation of fines beneath the side of the conveyor adjoining the coal face. According to the known method, the known problem of compensating for the improper "climb" of the cut attributable to this factor involves, first, detection of the "climb" using the inclinometer and, second, adjustment of the position of the cutting instrumentality in such a manner that the "climb" of the entire arrangement not interfere with the ability of the cutter loader to accurately follow the coal-rock interface at the roof.

These known automatic-control expedients are not suitable for many situations. These prior-art expedients presume the existence of a relatively definite and continuous interface between the coal and the neighboring rock, and the absence of significant geological discontinuities and irregularities. Accordingly, whereas the prior-art expedients may be suitable where the geology actually corresponds to such assumptions, they do not work well for example in Western Germany, where the geology of the mining regions is such that definite and continuous coal-rock interfaces are often not encountered.

Where the coal-rock interface is not sharply defined, the automatic-control arrangements of the prior art will not be able to locate the interface and accordingly will have no basis for controlling the heights of the cutting rollers of the cutter loader. Where the coal-rock interface is highly discontinuous and/or irregular, the automatical-control arrangements of the prior art will react to every discontinuity and irregularity, resulting in unacceptably great overcompensation, or even complete inability to successfully follow the interface.

SUMMARY OF THE INVENTION

It is accordingly a general object of the invention to provide a method and arrangement for the control of the operation of excavating machines, particularly cutter loaders, which is not characterized by the inadequacies discussed above.

It is a more specific object of the invention to provide a method and arrangement applicable to regions where the geology is such that sharply defined and continuous coal-rock interfaces are often not encountered in excavation work.

This object, and others which will become understandable upon a reading of the description, below, of a preferred embodiment, can be met, according to one advantageous concept of the invention, by resorting to a semi-automatic control of the operation of the excavating machine, especially a cutter loader.

Particularly advantageously, the thickness and inclination of a coal seam are determined at a plurality of spaced locations along the length of the face of the seam. These data are fed into a small special-purpose computer operatively connected to or mounted on the cutter loader. Based upon these data, the computer controls the positions of the cutting rollers of the cutter loader as the cutter loader travels along the length of the face conveyor during one or more passes.

Preferably, there are made only a limited number of measurements of the location and inclination of the upper (and when appropriate lower) coal-rock interface as a function of location, measured with respect to length along the coal face. Accordingly, it is desirable to interpolate between the measured values, to yield continuous and relative smooth variations of interface height and inclination along the length of the coal face. Such interpolation can be performed manually before feeding the data into the computer, or can be readily enough performed by the computer itself, particularly when the computer is a digital computer.

The continuous and relatively smooth variations of interface height and inclination, as a function of distance measured along the length of the coal face, are then employed to control the positions of the cutting intrumentalities of the cutter loader. The cutter loader is automatically caused to make a cut which corresponds to the continuous and relatively smooth variations of interface height and inclination, even though these height and inclination variations may not correspond with great exactness to the actual interface, assuming that any sharp interface exists at all.

This is in marked contrast to the operation of prior-art control arrangements in which an attempt is made to accurately detect and precisely follow the actual interface. The present control arrangement, which is only semi-automatic by comparison to the more completely automatic control arrangement of the prior art, follows the imaginary interface devised on the basis of the manually performed measurements.

When the actual interface is highly discontinuous or irregular, the imaginary interface will not correspond particularly closely to the actual interface (to the extent that the latter exists with any distinctness at all). Evidently, therefore, the cutter loader will remove, along with the coal being mined, a certain amount of adjoining rock, and furthermore will leave unmined a certain amount of coal lying beyond the imaginary interface. However, in the context of the highly discontinuous and irregular coal-rock interfaces to be found in certain mining regions, for example in West Germany as indicated before, this result is quite acceptable, especially when compared with the unsatisfactory results which can be achieved with the prior-art control arrangements of the type which attempt to automatically follow the actual interface.

The measurements from which the shape (location in space and inclination) of the coal-rock interface is determined are made before the cutter loader performs a pass (working trip). Preferably, to reduce the number of measurements which need be made, the interface information (position and inclination information) fed into the computer controls the operation of the cutter loader not only during the following pass, but during a plurality of successive passes. This is an acceptable procedure because, in fact, the shape (location in shape and inclination) of the interface usually does not change too greatly from one pass to the next, over several passes. When the controlling information, based upon experience in a particular excavation, or based upon a preselected programming schedule, has become stale, new measurements are taken, for use in the control of the next plurality of successive passes of the cutter loader.

Preferably, the face conveyor upon which the cutter loader is mounted defines the artificial horizontal with respect to which all measurements are made. The face conveyor is simply laid upon the floor of the excavation. Accordingly, it can be sufficient to perform measurements only of the height and inclination of the roof interface, measured with respect to this artifical horizontal.

According to a further advantageous concept of the invention, the imaginary interface established for the purpose of automatic control of the cutter loader takes into consideration the minimum clearance required by the cutter loader to clear the roof support structure of the seam. Thus, if from one pass to the next the bed becomes thinner, there will not always automatically result a corresponding reduction in the height of the working space. Although this means that a certain amount of adjoining rock will be cut, there is avoided the formation of a roof so low that, after installation of the roof support structure, the cutter loader cannot move through the working room. This is in contrast to the control arrangements of the prior art; because the latter attempt to follow the actual coal-work interface, the roof of the working space formed may be too low to permit passage of the cutter loader therethrough.

One problem with which the invention is particularly concerned is the problem of "climb" or "lift", resulting from the accumulation of fines underneath especially that side of the face conveyor which adjoins the face. According to the present invention, it is considered advantageous to employ an inclinometer for determining the actual inclination of the cut at each location along the length of the face, during the pass in which the cut is made. If an inclination other than the pre-programmed inclination for the locations in question is detected, a corrective action is initiated. Preferably, the corrective action does not occur during the pass in which the inclination error is detected, but instead is performed during the next-following pass. It is also preferred to effect the inclination correction through the particularly simple expedient of lowering the cutting rollers jointly, during the cutting of the corresponding loclation in the next pass, by a distance such that the lower cut will again be at the desired floor level.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
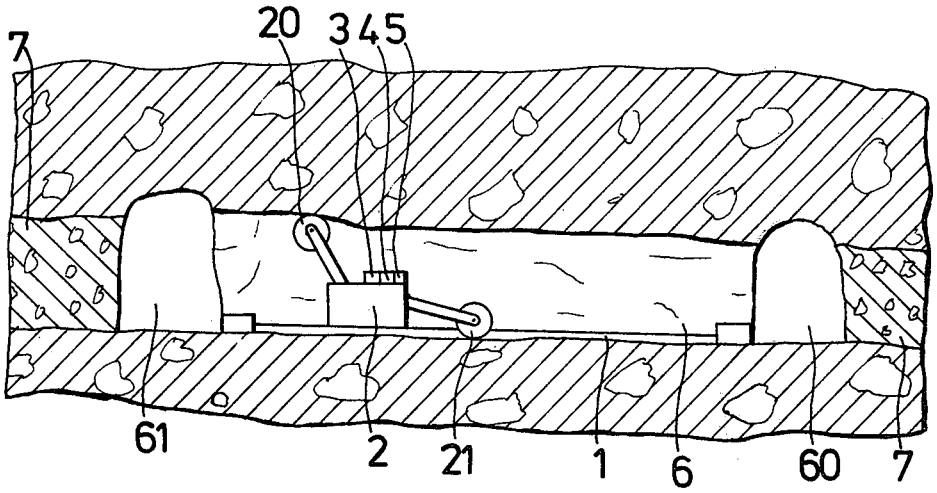
FIG. 1 is a schematic illustration of a cutter loader mounted on a face conveyor for travel along the length of the vertical face between two end passages which extend in direction transverse to the elongation of the face.
Figure 2:
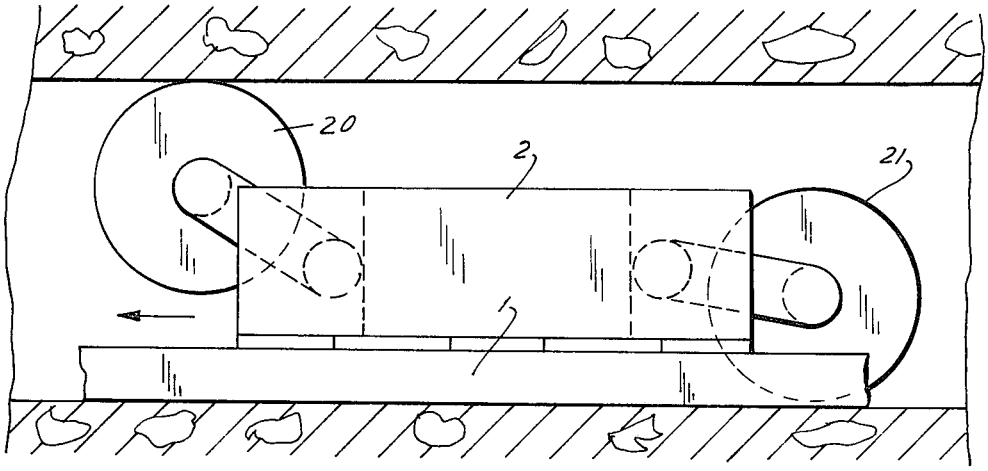
FIGS. 2, 3 and 4 are respectively side, top and end schematic views of the cutter loader mounted on the face conveyor.

FIG. 1 schematically depicts an excavation. The face 6 being worked is vertical (parallel to the picture plane) and extends between two horizontal passages 60, 61 (extending normal to the picture plane). Laid upon the floor of the working space and adjoining the vertical face 6, is a conventional face conveyor 1. The face conveyor 1 is typically an endless belt-type conveyor arrangement which moves mined coal from left to right, or from right to left, towards one of the passages 60 or 61.

Figure 3:
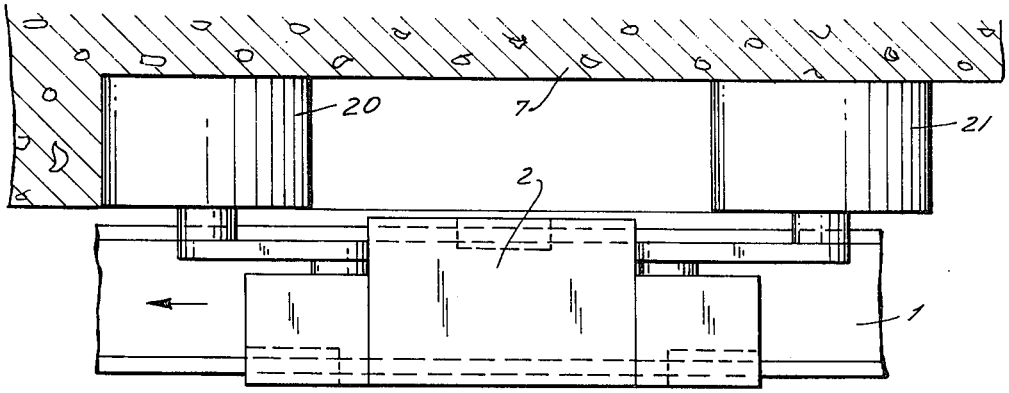
Figure 4:
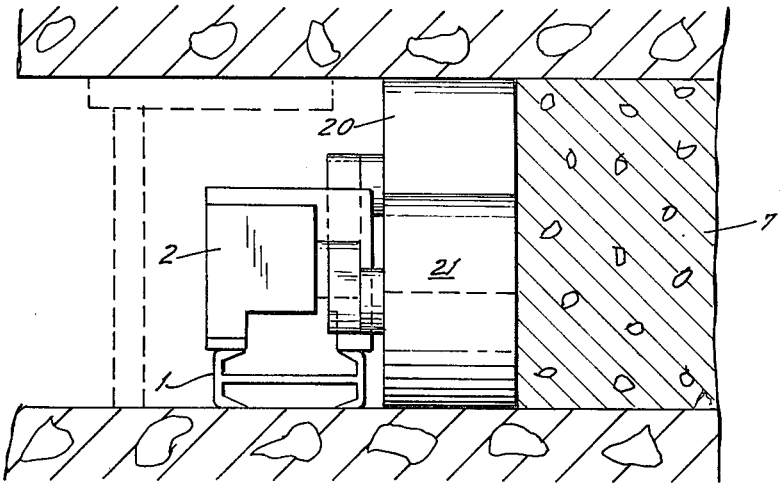

Mounted on face conveyor 1 is a cutter loader 2 having cutting rollers 20 and 21. The cutter loader 2 is mounted for movement along the length of the face conveyor 1 from one end thereof to the other. As can be seen particularly clearly in FIGS. 3 and 4, the cutting rollers 20, 21 are located considerably to the side of the face conveyor 1, so that the face conveyor 1 can be laid upon the floor of the part of the working passage formed during the previous pass whereas the cutting rollers 20, 21 cut through the coal seam 7 during the pass being performed. In the Figures, the cutting roller 20 cuts the upper portion of the seam 7, whereas the roller 21 cuts through the lower portion of the seam 7. The sum of the diameters of the two rollers is equal to or greater than the height (thickness) of the part of the seam being cut away.

During the performance of the pass in FIG. 1, the cutter loader 1 travels from right to left, i.e., from passage 60 to passage 61; the upper cutting roller 20 leads the lower cutting roller 21. Upon the completion of this pass, the face conveyor 1 and the cutter loader 2 are shifted deeper into the seam 7 (are shifted in direction normal to the picture plane of FIG. 1, are shifted rightwards in FIG. 4), for the performance of the next pass. During such next pass, the cutter loader 2 travels in opposite direction — i.e., left to right, from passage 61 to passage 60 — and the positions of the cutting rollers are exchanged; roller 21 becomes the upper roller and leads, whereas roller 20 becomes the lower roller and follows. The cutting rollers 20, 21 are conventional helical-feed-type cutting rollers which cause the mined coal to travel in direction axially of the rollers to a location above the face conveyor 1 and there to be dumped onto the conveyor 1 for travel to one of the side passages 60, 61.

As shown in FIG. 1, there are mounted on the cutter loader 2 a position indicator 3, an inclinometer 4 and a special-purpose computer 5, details of which will be explained below.

FIGS. 5–8 depict the conveyor and loader arrangement in end view at corresponding locations in four successive passes. FIGS. 5–8 are presented to depict the general idea of how an inclination error, shown considerably exaggerated in these Figures, arises and is corrected. A more precise description is presented further below.

Figure 5:
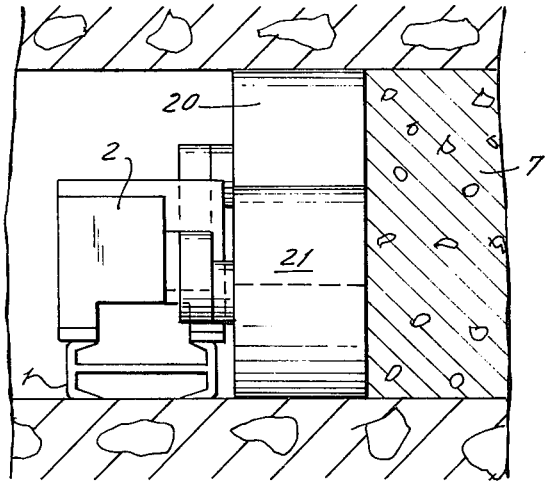
FIGS. 5, 6, 7 and 8 are end views of the cutter loader mounted on the face conveyor at corresponding locations in four successive passes, showing in a general way the manner of the formation and correction of an inclination error.

The coal seam 7 has a certain transverse inclination, not necessarily constant along the entire length of the face. This inclination, or inclination variation over the length of the face, has previously been determined by making measurements prior to the illustrated passes. For the sake of simplicity, the coal seam 7 is assumed to have a constant transverse inclination of 0°. As shown in FIG. 5, the cutter loader rollers 20, 21 are cutting along the face with the proper transverse inclination, namely 0°. It will be understood that in general the seam inclination will have some value other than 0°.

Figure 6:
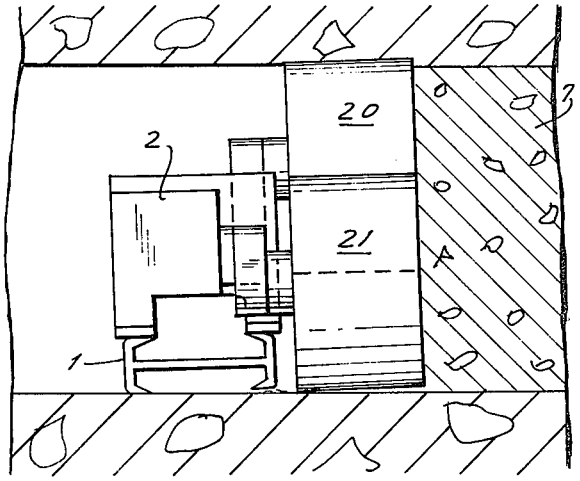

In the next pass, shown in FIG. 6, an inclination error has developed. The cause of this inclination error is assumed to be the accumulation of fines underneath that side of the face conveyor 1 which adjoins the face 6. As can be seen, as a result of the "climbing" of the cutter loader 2, the upper cutter roller 20 and the lower cutter roller 21, although they are properly positioned with respect to the face conveyor 1, are cutting too high and are likewise "climbing". This inclination error is detected by the inclinometer 4, and in principle it would be possible to effect a compensatory downwards shift of the cutting rollers 20, 21 at this time. However, a preferred alternative is to effect the requisite compensation when the cutter loader 2 is at the corresponding location in the next pass.

Figure 7:
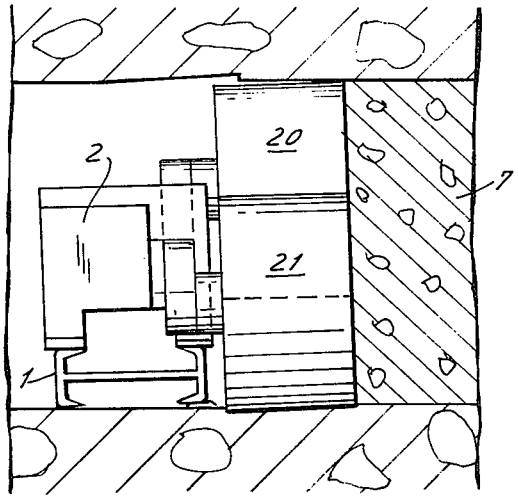

Such next pass is shown in FIG. 7. As can be seen, whereas in FIG. 6 the lower cutting roller 21 was cutting above the desired floor level, in FIG. 7 the roller 21 is cutting below the desired floor level. Specifically, the leading end (right-hand end as viewed in FIGS. 5–8) of the cutting roller 21 has been lowered down to the desired floor level. It is to be understood that the inclination error as shown in FIGS. 6 and 7 has been considerably exaggerated for the sake of explanation.

Figure 8:
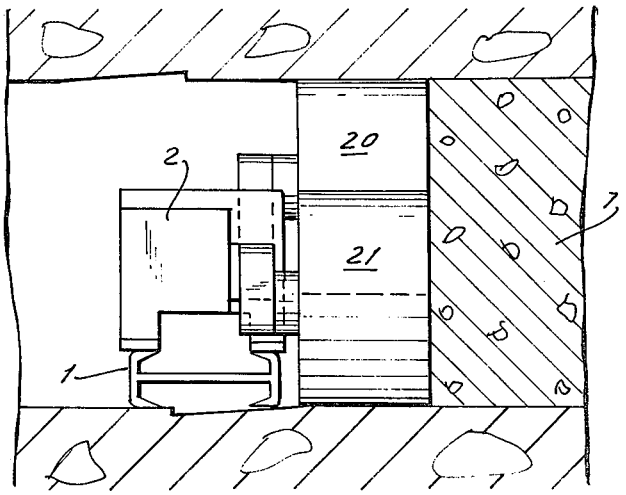

In FIG. 7, because the right-hand end of lower cutting roller 21 is at the desired floor level, it follows that the roller 21 will cut away a certain amount of rock or coal lying below the desired floor level, as particularly clearly seen in FIG. 8, which depicts the nextfollowing pass. The creation of this inclined rut does not actually present a problem. For one thing it will tend to be filled by loose rubble of the type which has accumulated under the face conveyor 1 and originally caused the inclination error. The important consideration is that, at least at the leading end (right-hand end) of the cut, the desired floor level has been restored, and this will eventually lead to reassumption by the face conveyor and cutter loader of the proper level and inclination. Complete reassumption of the proper level and inclination is shown in FIG. 8, although it should be understood that, depending upon the magnitude of the inclination error, the extent to which the inclination error is localized and does not prevail over the whole length of the face, and other factors, several passes may actually be required before the proper level and inclination are fully restored. This can be considered satisfactory; usually, it is more important that the "climbing" not continue undiminished and less important whether the inclination error is immediately eliminated altogether.

Figure 9:
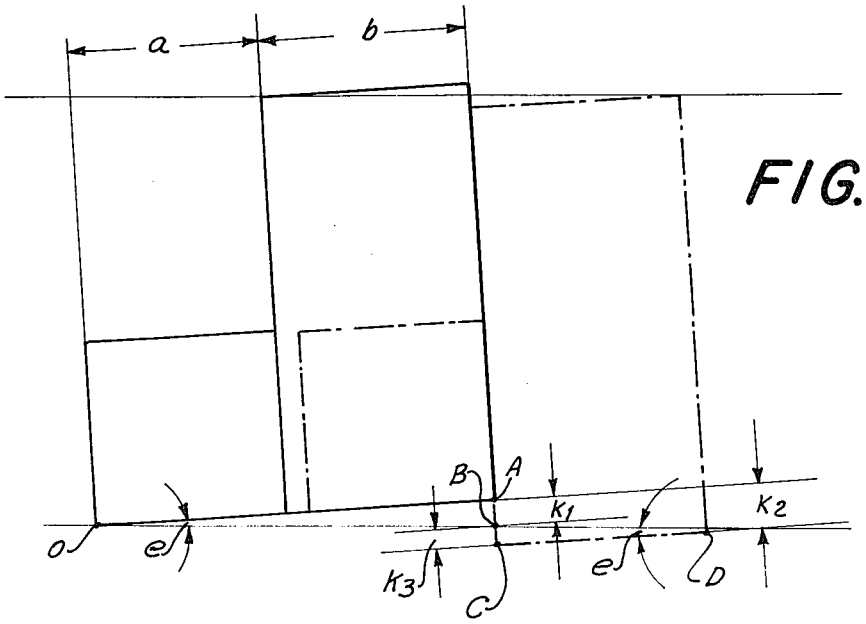
FIG. 9 is a schematic diagram showing the geometry of the inclination-correction action.

The geometry of the corrective action in FIGS. 5-8 is explained more precisely with respect to FIG. 9. FIG. 9 shows the position of the face conveyor and cutter loader at corresponding locations in two passes, in correspondence to FIGS. 6 and 7 just discussed. During the pass corresponding to FIG. 6, the inclination error $e$ has developed, for example due to the accumulation of fines under the face side of the conveyor. As a result, the cutting rollers 20, 21 cut too high. During the next pass, corresponding to FIG. 7, the two cutting rollers 20, 21 are jointly lowered a distance $k2$ in direction perpendicular to the plane of the (improperly inclined) face conveyor. As a result the leading end (right-hand end) of the lower cutting roller 21 is brought down from point A to point D; point D is coincident with the desired floor level, and in this way and to this extend the desired floor level is restored.

In the illustrated embodiment, the distance k2 by which the cutting rollers 20, 21 are jointly lowered to effect the requisite compensation is a straightforward function of the inclination error *e*. In FIG. 9, triangles OAB and BCD are both right triangles, with angles OAB and BCD being the right angles. With respect to right triangle OAB, the distance $kl = (a+b)(\tan e)$. With respect to right triangle BCD, the distance $k3 = (b)(\tan e)$. Since $k2 = k1 + k3$, it follows that $kz = (a=2b)(\tan e)$. This is the distance by which the cutting rollers 20, 21 should be lowered, perpendicular to the plane of the (improperly inclined) face conveyor, to effect the desired compensation action, in the illustrated exemplary embodiment.

It should be noted that this corrective action is preferred because despite its simplicity it produces satisfactory results. However, instead of shifting the cutting rollers 20, 21 downwards by the distance *k2* they could be shifted downwards according to some other preselected scheme calculated to yield more or less equivalent results. Likewise, use could be made of a more complicated corrective action involving, instead of or in addition to the downwards shift of the cutting rollers, a change of inclination of the cutting rollers relative to the remainder of the cutter loader or relative to the face conveyor 1, but this would of course require a specially designed cutter loader in which the inclination of the cutting instrumentalities can be so adjusted.

Finally, it should be noted that in FIG. 9, the inclination error *e* is shown as a positive angle, resulting from the accumulation of fines under the face side of conveyor 1. However, the inclination error *e* can result from other causes, and could have a negative value. In that event, the corrective action could involve raising, not lowering, the cutting rollers relative to the face conveyor, in a manner analogous to what has just been described.

Figure 10:
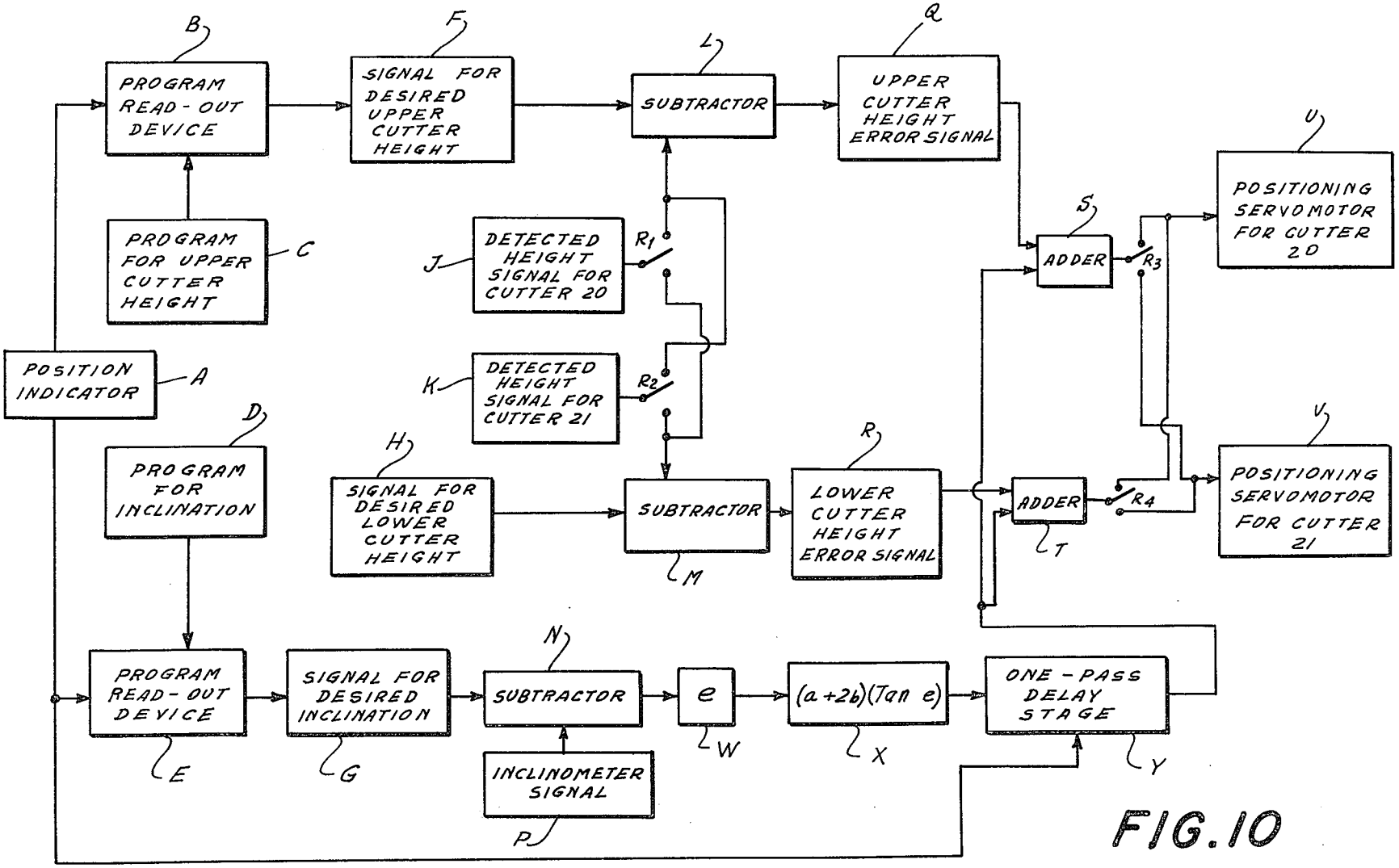
FIG. 10 is a block diagram of the control arrangement for the cutter loader.

FIG. 10 is a block circuit diagram of the control circuit and other parts of the control arrangement for the automatic cutter loader.

The elevations of the cutters 20, 21 in the illustrated embodiment are controlled by respective servomotors U and V which change the position of the cutters only upon the receipt of error signals. Error signals are furnished to the servomotors U, V from the outputs of adders S, T. The error signal at the output of adder S is the error signal for the upper cutter, whereas the error signal at the output of adder T is the error signal for the lower cutter. Because the cutter 20 is the upper cutter and the cutter 21 is the lower cutter during one pass, and vice versa during the next pass, the error signals at the outputs of adders S and T are respectively applied to servomotors U and V during one pass, and respectively applied to servomotors V and U during the next pass. This switchover is performed by means of relay switches R3, R4, controlled by means of a (non-illustrated) relay winding, which can be activated either manually or automatically at the end of a pass.

The operation of the control arrangement for the cutter loader will be described before describing how the control arrangement is actually programmed.

As the cutter loader 2 moves from one end of the face conveyor 1 to the other end during one pass, position indicator A generates a binary-coded output signal having a value directly indicative of where the cutter loader 2 is relative to one of the ends of the conveyor. Although the position indicator A is shown as having a single output line, persons skilled in the computer art will understand that this represents a set of parallel lines for transmitting the binary-coded position-indicating signal. For simplicity, the value of the position-indicating signal can be directly indicative of units of distance such as inches, feet, or the like, and can likewise be used without modification for addressing the read and write operations of the computer storage, in a manner explained below. The position indicator A can be constructed in a variety of ways. Very simply, the position indicator A can be essentially comprised of a long multi-track perforated tape which is wound between two reels, alternately serving as supply and take-up reels. As the cutter loader 2 travels along the face conveyor 1, a gear or the like rolls upon the side of the face conveyor and drives the take-up reel for the perforated tape. The number of parallel tracks on the tape is equal to the number of bits necessary to represent the largest-value distance coordinate to be represented. The perforations on the track are sensed by a transversely extending row of perforation detectors, which can be mechanical, photoelectric, pneumatic, or the like. Each detector in such row generates either a "0" or a "1" signal, depending upon whether a perforation is present or not present opposite the detector, and the combined output signals of the row of detectors constitute without modification the binary-coded position-indicating and computer-storage addressing signal. One advantage of the perforated-tape position indicator is that it involves no counting circuitry but is synchronized directly with cutter loader movement. Also, since the cutter loader, during two successive passes, moves in respective opposite directions, the problem of sequence reversal of the position-indicating and addressing signals does not arise, because the perforated tape will simply travel past the perforation detectors in one or the opposite direction.

The position-indicating signal from stage A is applied to a program read-out device B which reads out from the program storage C for the upper cutter height a binary number directly indicative of the proper elevation of the upper cutter, relative to the plane of the face conveyor, at this particular location intermediate the ends of the face conveyor. Stage F converts this binary-coded signal into a suitable analog control signal indicative of the proper elevation for the upper cutter, and this control signal is applied to one input of a subtractor L. The other input of subtractor L receives an actual-value signal directly indicative of the actual height of the upper cutter. As indicated above, the cutters 20, 21 alternately serve as the upper cutter. Accordingly, the actual-value signal received by subtractor L will indicate the detected height of the cutter 20, or else of the cutter 21, depending upon which of these two cutters is serving as the upper cutting during the pass in question. The actual-height signals for the cutters 20 and 21 are furnished by respective transducers J and K. The outputs of transducers J and K are alternately connectable to the second input of subtractor L by means of relay switches R1, R2 which are activated in unison with the relay switches R3, R4 mentioned above.

The output signal of subtractor L is applied to a circuit stage Q at whose output appears a first cutter-height error signal, independent of transverse cutter inclination. This first cutter-height error signal is applied to the upper input of adder S. The lower input of adder S receives a second cutter-height error signal, dependent solely upon transverse inclination error. For the sake of simplicity, it will be assumed initially that the inclination error is zero, so that only the signal applied to the upper input of adder S need be considered. Accordingly, the first cutter-height error signal, independent of cutter inclination, passes through adder S and is applied to whichever one of the servomotors U and V is associated with the cutter which is serving as the upper cutter during the pass in question. Accordingly, assuming that no inclination error develops, the upper cut will correspond to the pre-programmed imaginary coal-rock interface which is to form the roof of the working space.

The control of the lower cutter is somewhat simpler, because the height of the lower cutter will ordinarily bear a fixed relation to the plane of the face conveyor 1.

A transducer H, such as a manually settable potentiometer, is used to generate a fixed signal indicative of how high the lower cutter should be, relative to the plane of the face conveyor 1. This cutter-height control signal is applied to one input of a subtractor M. The other input of subtractor M receives an actual-height signal from one of the two feedback transducers J and K, depending upon which one of the two cutters 20, 21 is serving as the lower cutter. The output signal of subtractor M is applied to circuit stage R, at whose output appears a suitable electrical cutter-height error signal, independent of any inclination error.

This error signal is applied to the upper input of adder T. The lower input of adder T receives a further cutter-height error signal, dependent exclusively upon detected inclination error. For the purpose of explanation, it will again be assumed that no inclination error has arisen, so that no signal is applied to the lower input of adder T. Accordingly, the cutter-height error signal applied to the upper input of adder T passes to the output thereof, and from there is applied to either servomotor U or servomotor V, depending upon which cutter is serving as the lower cutter during the pass in question.

From the foregoing, it will be appreciated that the elevations of both the upper cutter and the lower cutter, measured relative to the plane of the face conveyor, are controlled be negative feedback. However, whereas in general the elevation of the upper cutter is controlled to follow the pre-programmed imaginary coal-rock interface, the elevation of the lower cutter is controlled to maintain a fixed elevation relative to the face conveyor 1.

The effect of inclination errors will now be considered.

As the cutter loader 2 moves from one end of the face conveyor 1 to the other, the position indicator A generates a corresponding position-indicating signal. This signal is applied to a program read-out device E, which effects read-out of a program storage D for the pre-programmed imaginary seam inclination. Accordingly, for each position of the cutter loader 2 intermediate the conveyor ends, there will appear at the output of read-out device E a signal which is applied to circuit stage G, at whose output there appears a suitable analog control signal indicative of the proper inclination for the cutter loader 2. This desired-inclination signal is applied to one input of subtractor N. The other input of subtractor N receives an actual-inclination signal from an inclinometer P. The output signal of subtractor N is applied to a circuit stage W at whose output appears an electrical inclination-error signal $e$. The inclination-error signal $e$ is applied to a circuit stage X having the transfer function $(a-2b)$ (tan $e$). The output signal of stage X has a value directly indicative of the distance $k2$ by which the upper and lower cutting rollers should be jointly lowered or raised.

This signal is applied to the input of a one-pass delay stage Y (depicted in greater detail in FIG. 11 and described below). Delay stage Y applies the inclination-error-dependent cutter-height-error signal from the output of stage X to the lower inputs of adders S and T, not immediately, but instead when the cutter loader 2 is at the corresponding location in the next pass (i.e., during the next-following working trip of the cutter loader). At that time, the inclination-error-dependent cutter-height-error signal is superimposed, by the adders S and T, upon the inclination-error-independent cutter-height-error signals. Persons familiar with servo-system theory will understand that, as a result, the inclination-error compensation will be superimposed upon the inclination-independent cutter-height-error compensation, producing the action described in a general way with respect to FIGS. 5–8.

Figure 11:
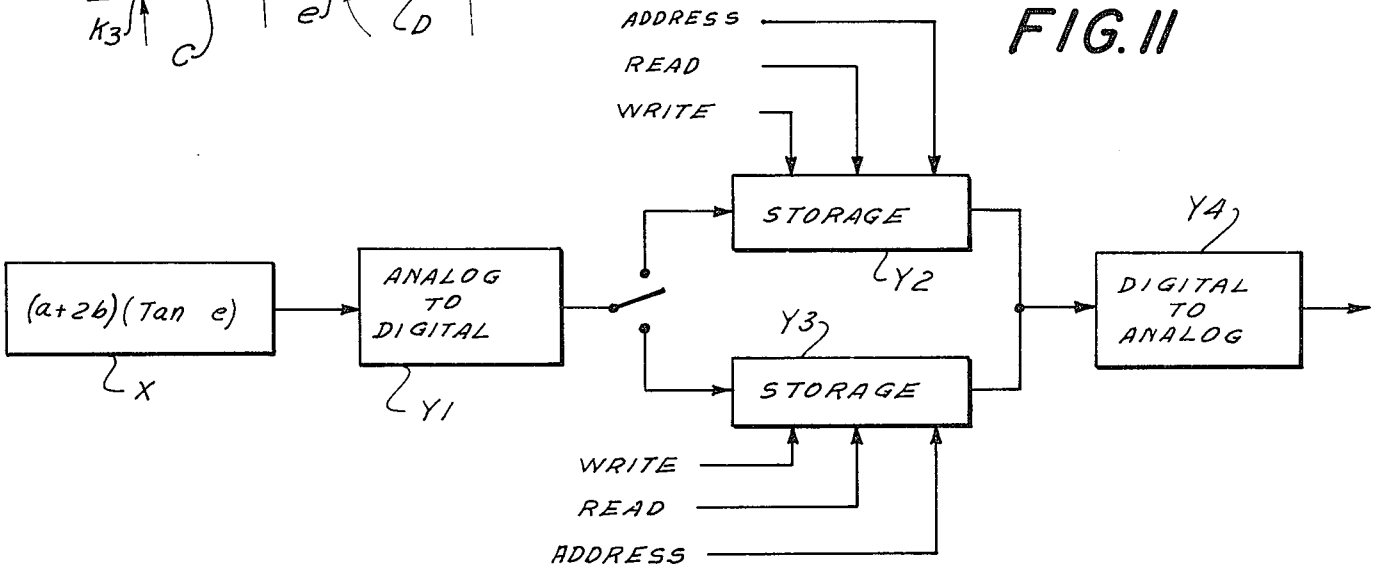
FIG. 11 is a block diagram of the one-pass delay stage of FIG. 10.

FIG. 11 depicts in somewhat greater detail the configuration of the one-pass delay stage Y of FIG. 10. The delay stage Y comprises an analog-to digital converter Y1, two digital storages Y2 and Y3, and a digital-to-analog converter Y4. The inclination-error-dependent cutter-height-error signal at the output of stage X is applied, first of all to analog-to-digital converter Y1. The corresponding binary-coded output signal (shown as being transmitted on a single line, but in fact transmitted on a set of parallel lines) is transmitted to storage Y2 during one pass of the cutter loader, and to storage Y3 during the next pass, the application alternating from one pass to the next. The alternate transmission is accomplished by means of a further relay switch belonging to the set mentioned above and activated, automatically or manually, at the end of each pass.

The output signal of position indicator A, binary-coded and directly indicative of the position of the loader, can be used, unmodified, as an address signal for the storages Y2, Y3. Accordingly, the address signal inputs of each storage Y2, Y3 are connected to the output of position indicator A. Again, whereas each address signal input is shown as a single line, it will be understood that such line represents a set of parallel lines equal in number to the set of parallel output lines of the position indicator A.

Each storage Y2, Y3 is comprised of a large number of storage units directly addressable by the position-indicating signal from the output of stage A. Each storage Y2, Y3 has a read control signal input and a write control signal input. During one pass of the cutter loader, one storage is in the write mode and receives signals from the output of converter Y1, whereas the other storage is in the read mode and furnishes signals to digital-to-analog converter Y4; during the next pass of the cutter loader, the situation is reversed. The application of read and write control signals to the storages Y2, Y3 is likewise accomplished very simply by the use of further relay switches, all associated in the aforedescribed manner with the relay winding mentioned earlier. The output signal of digital-to-analog converter Y4 constitutes the output signal of the one-pass delay stage Y of FIG. 10, and is applied to the lower inputs of adders S and T in FIG. 10, as described earlier.

It will be understood that the circuit configuration just described is but exemplary, and that the invention is not limited to the use of the specific digital-computer circuit expedients described; for example, a variety of completely analog expedients can be used.

With respect to the illustrated embodiment, there remains to be discussed only the programming of the storages C and D for the inclination and upper-cutter-height programs.

Essentially the storages C and D can be simple addressable read-write storages like storages Y2 and Y3 in FIG. 11. Accordingly, it is not believed necessary to illustrate them. The data concerning the location and inclination of the coal-rock interface for a number of different positions along the length of the face 6 is fed into respective storage units in storages C and D, each storage unit corresponding to a particular location along the interface. As a particular datum (representative of the interface position or inclination at a particular location) is fed into one of the storages C or D, a corresponding address signal must be applied to the storage, so that the datum is registered by the proper storage unit. If the measurements which yield these data are performed as the loader moves along the conveyor, for example during a non-working trip, then the address signal can be furnished from the position indicator A itself, and it is merely necessary to feed in (for example by means of a keyboard) the seam height and inclination data for each location. Alternatively, if the imaginary variation of interface position and inclination as a function of length along the face is plotted as a separate operation, for example on a piece of paper, based upon the measurement results, a human programmer can use the keyboard to type in both the interface-height and inclination information, and also the requisite address signals, so that the interface-height and inclination information will be fed to the proper storage units in storages C and D.

As explained earlier, it is desired that the imaginary functional variations of interface-height and inclination along the length of the face, set up for control of the loader, be continuous and relatively smooth. In view of that consideration, it is advantageous to employ a conventional interpolator for feeding information into the storages C and D. In that way, the human or automatic programmer need feed in only a relatively small number of discrete interface-height and inclination measurements, and corresponding location coordinate information. The interpolator then automatically interpolates between the measurement data to construct smooth curves from such data, and then converts such curves into discrete interface-height, inclination and spatial-coordinate information which it automatically feeds into the actual storages C and D, with proper addressing. Although the operation of such an interpolator is actually quite complicated, it is per se so conventional in the electronic computer art as to make unnecessary any more detailed explanation here.

It hardly need be explained that there exist many other ways of feeding into the storages C and D the information obtained from the interface-height and inclination measurements. In selecting the method employed, the principal consideration should be minimum demand upon the skill and intelligence of the human programmer. This is one reason why automatic addressing, accomplished by moving the position indicator A along the face as the measurements are made, combined with the use of an automatic interpolator, is very advantageous.

It will be understood that each of the elements described above, or two or more together, may also find a useful application in other types of circuits and constructions differing from the types described above.

While the invention has been illustrated and described as embodied in a cutter loader and control arrangement therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of controlling the operation of an excavating machine of the type which during a working trip works the face of an excavation, particularly a cutter loader mounted for movement along the length of a face conveyor, or the like, comprising, in combination, the steps of determining the shape of a mineral interface along the length of the face of an excavation by performing mineralogical measurements at a plurality of locations along the length of the face; setting up an interface-shape program in a programmable control arrangement operative for causing the excavating machine to excavate in accordance with the program during at least one working trip; and thereafter causing the excavating machine to perform at least one working trip under the automatic control of the control arrangement, wherein said step of determining the shape of the mineral interface along the length of the face includes determining the inclination of the interface along the length of the face; further including the steps of detecting the discrepancy between the inclination of the interface and the inclination of the cut made by the excavating machine along the length of the face during one working trip and registering corresponding information in an information storage device; and compensating for the discrepancy by causing the control arrangement to modify the operation of the excavating machine during the next working trip in dependence upon the stored information.

2. A method as defined in claim 1, the excavation being such that the mineral interface is not well-defined, continuous and smooth, wherein said step of setting up an interface-shape program in the programmable control arrangement comprises setting up in the programmable control arrangement an interface-shape program corresponding to an interface which is well-defined, continuous and smooth by comparison with the acutal interface, whereby to make possible automatic working of an excavation not capable of being worked by automatic excavating machines of the type which automatically detect the physical interface during a working trip and excavate in dependence upon such automatic detection.

3. An automatic excavating machine of the type which during a working trip works the face of an excavation, particularly a cutter loader mounted for movement along the length of a face conveyor, or the like, comprising, in combination, cutting means; moving means for moving said cutting means; information storage means operative for storing simultaneously information representative of the shape of a mineral interface at a plurality of locations spaced along the length of the face of an excavation; and control means operative for causing said moving means to move said cutting means in dependence upon the information stored by said information storage means during movement of the excavating machine along the face, wherein said information storage means comprises means operative for storing simultaneously information representative of the inclination of the mineral interface, measured in direction transverse to the direction in which the machine moves during a working trip, at a plurality of locations spaced along the length of the face, and wherein said control means comprises means operative during a working trip of the machine for continually determining the location of the machine relative to the ends of the face, inclination-measuring means operative for determining the inclination of the cut, measured in direction transverse to the direction in which the machine moves during the working trip, and inclination-error-correcting means operative for correcting inclination errors by causing said moving means to effect compensatory changes of the position of said cutting means.

4. A machine as defined in claim 3, wherein said inclination-error-correcting means comprises storage means operative for registering the inclination errors detcted during one working trip and means for compensating for such errors by causing said moving means to effect compensatory changes of only the height of said cutting means during the next working trip.

5. A machine as defined in claim 3, wherein said inclination-error-correcting means comprises storage means operative for registering the inclination errors detected during one working trip and means for automatically effecting compensation of such errors during but not until the next working trip and then by effecting compensatory changes of the position of said cutting means during such next working trip.

6. A method of controlling the operation of a cutter loader mounted for movement on a face conveyor along the face of an excavation and provided with a position indicator mounted on the cutter loader for indicating where the cutter loader is relative to the conveyor and provided with an inclinometer mounted on the loader for detecting improper transverse climbing of the face conveyor and cutter loader, comprising, in combination, the steps of performing manual mineralogical measurements prior to the first working trip of the cutter loader and from those determining, relative to a reference plane constituted by the face conveyor, the desired heights for the upper and lower cuts and the desired transverse inclination of the cut, and registering such desired-cut information in the storage of a computer; thereafter causing the cutter loader to perform a first working trip under the automatic control of the computer and in accordance with the desired-cut information; during the course of said first working trip using the inclinometer to detect discrepancies between the transverse inclination of the cut made by the cutter loader and the desired transverse inclination, and registering such inclination discrepancies; causing the cutter loader to perform a second working trip; and during the performance of said second working trip causing the computer to automatically control the operation of the cutter loader in accordance with both the desired-cut information registered prior to said first working trip and furthermore in accordance with the inclination discrepancies registered during the performance of said first working trip.

7. An excavating arrangement, comprising, in combination, a face conveyor defining a reference plane; a cutter loader mounted on said face conveyor for movement along the length of said face conveyor, said cutter loader including adjustable-position cutting rollers; a position indicator mounted on said cutter loader for generating a signal indicative of the position of said cutter loader relative to said face conveyor; an inclinometer mounted on said cutter loader for generating a signal indicative of the transverse inclination of the cutter loader and face conveyor; and an adjustable-program process computer connected to said position indicator and to said inclinometer for receiving said signals and operative for automatically adjusting the positions of said cutting rollers in dependence upon said signals and upon an adjustable program.

* * * * *